US011133602B2

(12) United States Patent
Pernstål et al.

(10) Patent No.: US 11,133,602 B2
(45) Date of Patent: Sep. 28, 2021

(54) ANTENNA STACK

(71) Applicant: CORNING INCORPORATED, Corning, NY (US)

(72) Inventors: Thomas Lars Willhelm Pernstål, Halland (SE); Mikael Bror Taveniku, Painted Post, NY (US); Mark Peter Taylor, Montour Falls, NY (US)

(73) Assignee: CORNING INCORPORATED, Corning, NY (US)

( * ) Notice: Subject to any disclaimer, the term of this patent is extended or adjusted under 35 U.S.C. 154(b) by 0 days.

(21) Appl. No.: 16/881,328

(22) Filed: May 22, 2020

(65) Prior Publication Data

US 2020/0287295 A1 Sep. 10, 2020

Related U.S. Application Data

(62) Division of application No. 16/353,309, filed on Mar. 14, 2019, now Pat. No. 10,700,440.
(Continued)

(51) Int. Cl.
*H01Q 21/06* (2006.01)
*H01Q 21/00* (2006.01)
(Continued)

(52) U.S. Cl.
CPC ..... *H01Q 21/065* (2013.01); *H01Q 1/38* (2013.01); *H01Q 9/0414* (2013.01); *H01Q 21/0006* (2013.01)

(58) Field of Classification Search
CPC ..... H01Q 21/065; H01Q 21/0006; H01Q 21/0093; H01Q 1/38; H01Q 9/0414; H01Q 9/0457; H01Q 1/40
See application file for complete search history.

(56) References Cited

U.S. PATENT DOCUMENTS 2,622,198 A 12/1952 Clapp et al.
4,623,893 A 11/1986 Sabban
(Continued)

FOREIGN PATENT DOCUMENTS

CN 101036153 A 9/2007
CN 204206611 U 3/2015
(Continued)

OTHER PUBLICATIONS

International Search Report and Written Opinion of the International Searching Authority; PCT/US2020/013973; dated April 24, 2020; 10 Pages; European Patent Office.

*Primary Examiner* — Hoang V Nguyen

(57) ABSTRACT

An antenna stack includes a glass cover having an outer face, an inside face opposite the outer face, and a body therebetween. The glass cover additionally has a cavity formed therein, extending into the body from the inside face. The antenna stack further includes an antenna patch positioned within the cavity, and a waveguide layer. The waveguide layer includes polycrystalline ceramic underlying the glass cover. Conductive vias extend through the polycrystalline ceramic and partition the waveguide layer to form feed channels through the polycrystalline ceramic, and major surfaces of the polycrystalline ceramic are overlaid with a conductor having openings that open to the feed channels. The antenna patch is spaced apart from the waveguide layer to facilitate evanescent wave coupling between the feed channels and the antenna patch.

13 Claims, 5 Drawing Sheets

Related U.S. Application Data

(60) Provisional application No. 62/796,884, filed on Jan. 25, 2019.

(51) Int. Cl.
*H01Q 1/38* (2006.01)
*H01Q 9/04* (2006.01)

(56) References Cited

U.S. PATENT DOCUMENTS

| | | | |
|---|---|---|---|
| 4,816,836 | A | 3/1989 | Lalezari |
| 5,227,749 | A | 7/1993 | Raguenet et al. |
| 5,400,040 | A | 3/1995 | Lane et al. |
| 6,999,032 | B2 | 2/2006 | Pakray et al. |
| 7,119,753 | B2 | 10/2006 | Hidai et al. |
| 7,348,932 | B1 | 3/2008 | Puzella et al. |
| 7,394,382 | B2 | 7/2008 | Nitzan et al. |
| 7,545,329 | B2 | 6/2009 | Gaucher et al. |
| 7,728,774 | B2 | 6/2010 | Akkermans et al. |
| 8,018,375 | B1 | 9/2011 | Alexopoulos et al. |
| 8,040,286 | B2 | 10/2011 | Matsuo et al. |
| 8,154,457 | B2 | 4/2012 | Van Der Poel |
| 8,525,729 | B1 | 9/2013 | Martin |
| 9,553,371 | B2 | 1/2017 | MacDonald et al. |
| 9,887,449 | B2 | 2/2018 | Qiang et al. |
| 10,050,336 | B2 | 8/2018 | Wang et al. |
| 10,077,208 | B2 | 9/2018 | Amosov et al. |
| 2005/0146397 | A1 | 7/2005 | Koga et al. |
| 2009/0015485 | A1 | 1/2009 | Floyd et al. |
| 2009/0309680 | A1 | 12/2009 | Suzuki |
| 2013/0050016 | A1 | 2/2013 | Kim et al. |
| 2016/0293557 | A1 | 10/2016 | Topak et al. |
| 2016/0322708 | A1 | 11/2016 | Tayfeh Aligodarz et al. |
| 2018/0316090 | A1 | 11/2018 | Foo |
| 2019/0198973 | A1* | 6/2019 | Chen ..... H01L 23/53257 |

FOREIGN PATENT DOCUMENTS

| | | | |
|---|---|---|---|
| DE | 102005048274 | A1 | 4/2007 |
| EP | 2144329 | A1 | 1/2010 |
| EP | 2159876 | A1 | 3/2010 |
| EP | 2267841 | A1 | 12/2010 |
| JP | 2007-174390 | A | 7/2007 |
| KR | 10-2005-0021235 | A | 3/2005 |
| KR | 10-0986230 | B1 | 10/2010 |
| KR | 10-2013-0023104 | A | 3/2013 |
| WO | 2015/089643 | A1 | 6/2015 |
| WO | 2018/004684 | A1 | 1/2018 |
| WO | 2018/125240 | A1 | 7/2018 |
| WO | 2018/200916 | A1 | 11/2018 |

* cited by examiner

ANTENNA STACK

PRIORITY

This application is a divisional and claims the benefit of priority of under 35 U.S.C. § 120 of U.S. application Ser. No. 16/353,309, filed on Mar. 14, 2019, which claims the benefit of priority under 35 U.S.C. § 119 of U.S. Application No. 62/796,884 filed Jan. 25, 2019, which are incorporated by reference herein in their entirety.

BACKGROUND

Aspects of the present disclosure relate generally to a stack of thin glass and ceramic material, such as packaging and componentry for an antenna.

Small, portable antennas, such as multi-channel antenna arrays for multiple-input and multiple-output systems, especially those designed for rugged handling, typically include a variety of components. Such components may include circuitry wired to a waveguide, in turn wired to radiative elements for transmission and receipt of signals, such as radio frequency signals. Quality of the signals may be lost as the signals are transferred between mediums, passing through and between the variety of components of the antennas, such as due to crosstalk, losses in transitions, distribution of signals, etc. Furthermore, such antennas typically require protection from rough handling and the environment, such as through robust cover sheets that may further degrade the signals. A need exists for an antenna design that reduces signal loss and/or at the same time improves toughness of antenna systems or provides other advantages as described herein.

SUMMARY

At least some embodiments relate to an antenna stack, which includes a glass cover having an outer face, an inside face opposite the outer face, and a body therebetween. The glass cover additionally has a cavity formed therein, extending into the body from the inside face. The antenna stack further includes an antenna patch positioned within the cavity, and a waveguide layer. The waveguide layer includes polycrystalline ceramic underlying the glass cover. Conductive vias extend through the polycrystalline ceramic and partition the waveguide layer to form feed channels through the polycrystalline ceramic. Major surfaces of the polycrystalline ceramic are overlaid with a conductor having openings that open to the feed channels. The antenna patch in the cavity is spaced apart from the waveguide layer to facilitate evanescent wave coupling between the feed channels and the antenna patch.

Additional features and advantages are set forth in the Detailed Description that follows, and in part will be readily apparent to those skilled in the art from the description or recognized by practicing the embodiments as described in the written description and claims hereof, as well as the appended drawings. It is to be understood that both the foregoing general description and the following Detailed Description are merely exemplary, and are intended to provide an overview or framework to understand the nature and character of the claims.

BRIEF DESCRIPTION OF THE FIGURES

The accompanying Figures are included to provide a further understanding, and are incorporated in and constitute a part of this specification. The drawings illustrate one or more embodiments, and together with the Detailed Description serve to explain principles and operations of the various embodiments. As such, the disclosure will become more fully understood from the following Detailed Description, taken in conjunction with the accompanying Figures, in which.

DETAILED DESCRIPTION

Before turning to the following Detailed Description and Figures, which illustrate exemplary embodiments in detail, it should be understood that the present inventive technology is not limited to the details or methodology set forth in the Detailed Description or illustrated in the Figures. For example, as will be understood by those of ordinary skill in the art, features and attributes associated with embodiments shown in one of the Figures or described in the text relating to one of the embodiments may well be applied to other embodiments shown in another of the Figures or described elsewhere in the text.

Figure 1:
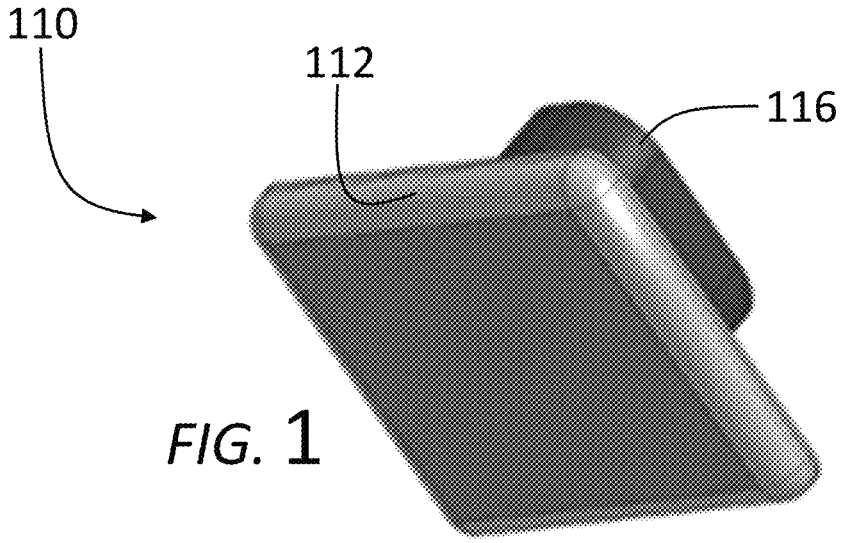
FIG. 1 is a perspective view of an antenna according to an exemplary embodiment.
Figure 2:
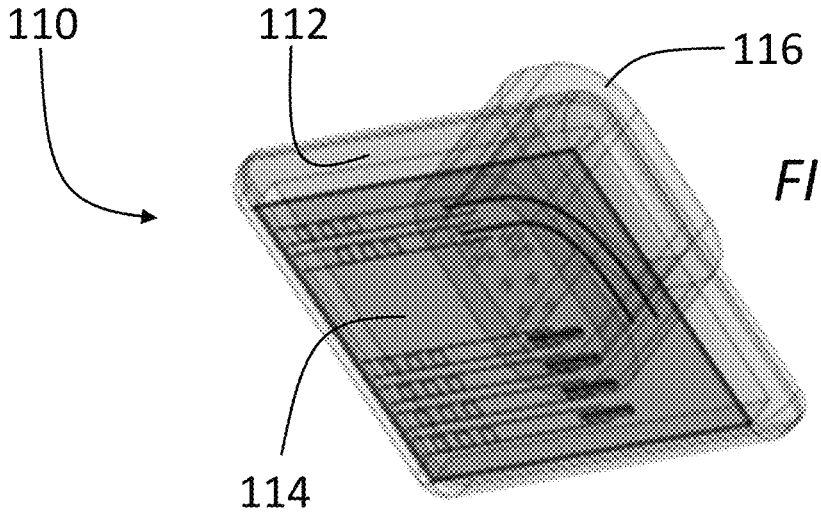
FIG. 2 is a perspective view of a 'skeleton' of the antenna of FIG. 1, showing internal componentry.

Referring to FIGS. 1-2, equipment, such as an antenna 110, includes a housing 112 supporting an antenna stack 114 (FIG. 2). The housing 112 may provide a rigid frame to hold the antenna stack 114, or may simply provide an aesthetic design. In some embodiments, the antenna stack 114 may be bonded to other componentry or systems, such as a portable electronic device, where the housing 112 supports more than the antenna stack 114. For example, the housing 112 may provide a fastening structure 116 to connect the antenna 110 to a vehicle, wall, window, tower, or other body. Power may be supplied to the antenna 110 through conductors within the fastening structure 116 (e.g., automobile-style connector), for example. According to an exemplary embodiment, the antenna 110 has a compact, robust design, where the antenna stack 114 fits tightly within the housing 112, such that the entire antenna 110 has a low, thin profile, which may be useful for improved aerodynamics and/or aesthetics. Further, embodiments disclosed herein additionally have improved dimensional precision, minimizing thermal effects on the antenna structures due to the dimensions and arrangement of the stack as disclosed herein (see, e.g., antenna stack 910 of FIG. 13).

Figure 3:
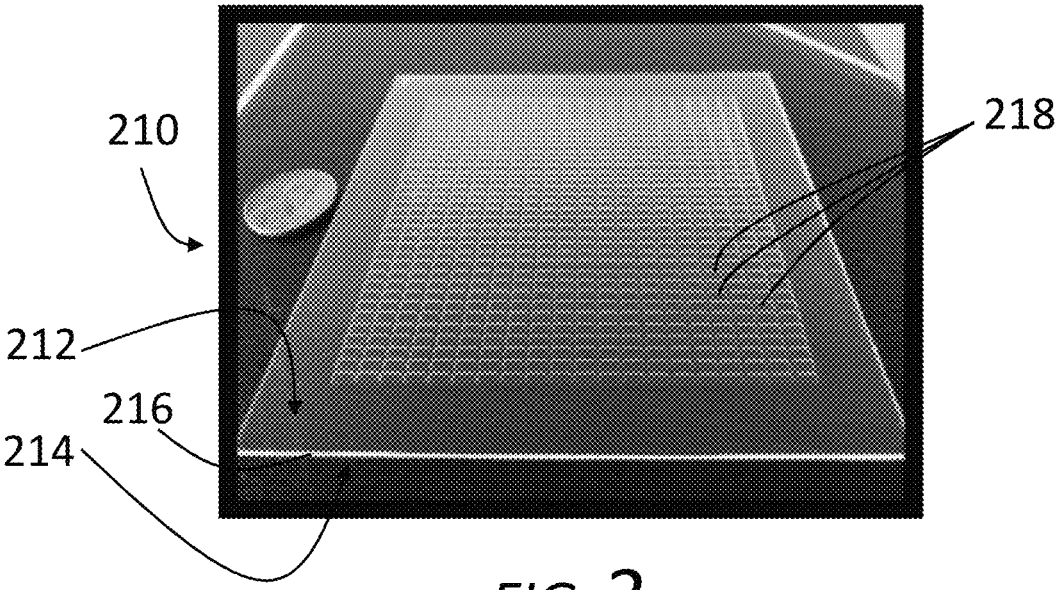
FIG. 3 is a digital image from a perspective view of a glass cover with cavities, according to an exemplary embodiment.

Referring to FIG. 3, a cover, shown as a glass cover 210, has an outer face 212, an inside face 214 opposite the outer face 212, and a body 216 therebetween. According to an exemplary embodiment, the body 216 is a monolithic, continuous structure, such as a sheet of glass. In some such embodiments, the body 216 is formed from a single glass, while in other embodiments the body 216 may be formed from layers of glass that are directly laminated to one another. In contemplated embodiments, the cover may be or include materials other than glass, such as polymer. However, glass may be preferred due to thermal expansion properties, precision forming, low degradation, rigidity, strength, and other properties.

According to some such embodiments, the glass cover 210 is strengthened, such as chemically strengthened, tempered, and/or having exterior portions pulled into compression by an interior core in tension. In some such embodiments, the glass cover 210 has a variable stress profile where the outer face 212 is in compression (e.g., at least 100 megapascals (MPa) of compression). With sufficient strength, the cover 210 may be strong enough to protect the antenna without need for additional covers or protection, facilitating low-loss signal transfer through the antenna.

According to an exemplary embodiment, the glass cover 210, or other covers, includes a cavity 218 (e.g., cavities) formed in the glass cover 210. The cavity 218 extends into the body 216 of the glass cover from the inside face 214. Photolithography and etchants, laser ablation, press forming, or other techniques may be used to form the cavity 218. According to an exemplary embodiment, the cavity 218 extends into the body 216 but does not extend fully through the body 216, allowing a sufficient portion of the glass cover 210 to provide protection for the cavity 218 and other components of the antenna. In some embodiments, the cavity is formed to a depth, relative to the inside face 214, of at least 10 micrometers (μm), such as at least 20 μm, at least 50 μm, and/or no more than 500 μm, such as no more than 300 μm, or no more than 200 μm. Thickness of the glass cover 210, between the outer face 212 and the inside face 214 may be less than 1 millimeter (mm), such as less than 800 μm, less than 600 μm, less than 500 μm, less than 300 μm, less than 200 μm or thinner in some embodiments, and/or at least 30 μm, such as at least 50 μm, at least 75 μm, or at least 100 μm.

Figure 4:
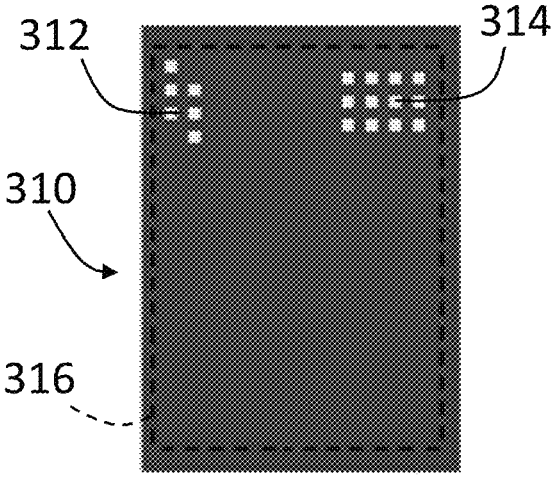
FIG. 4 is a top view of a cover with cavities, according to another exemplary embodiment.
Figure 5:
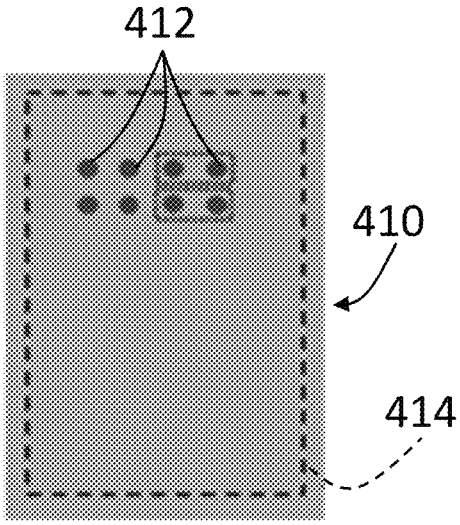
FIG. 5 is a bottom view of a backplate with filled vias, according to an exemplary embodiment.

Referring to FIGS. 4-5, a glass cover 310 includes arrays of cavities 312, 314 and a mating glass backplate 410 includes through-vias 412, which may be filed with a conductor (e.g., conductor or conductive, meaning exhibiting conductivity of at least $10^4$ siemens per meter at 20° Celsius (C)), such as copper, aluminum, gold, silver, translucent conductive oxide (e.g., indium tin oxide, zinc oxide) etc., to facilitate transmission of power and/or information through the backplate 410 or along a substrate. According to an exemplary embodiment, the glass cover 310 and backplate 410 may be welded (e.g., laser welded) together, such as along respective weld lines 316, 414, providing a hermetic seal between the glass cover 310 and backplate 410, sealing components internal thereto.

Figure 6:
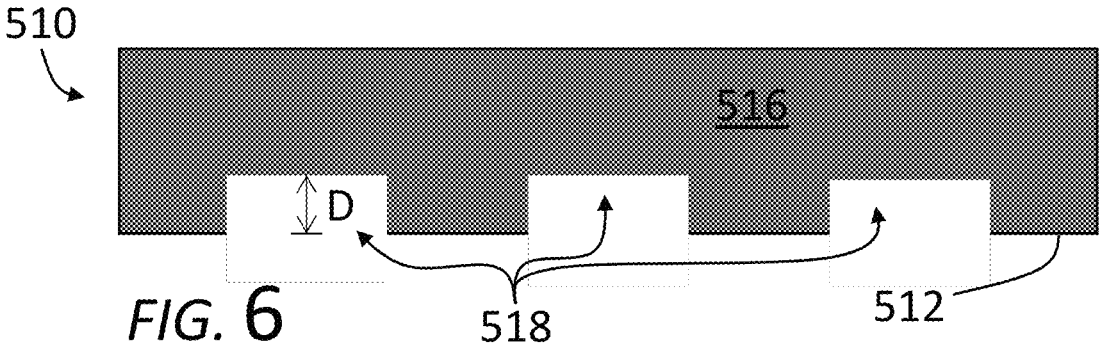
FIGS. 6-8 are conceptual diagrams from sectional perspectives of covers having cavities, according to various exemplary embodiments.
Figure 7:
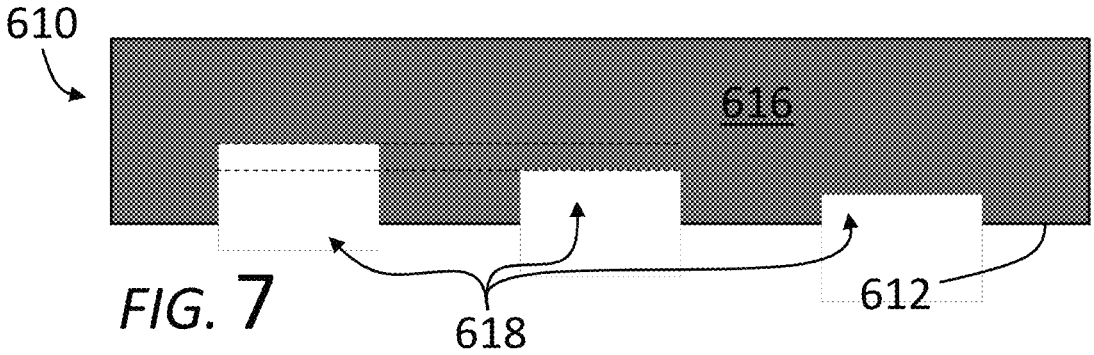
Figure 8:
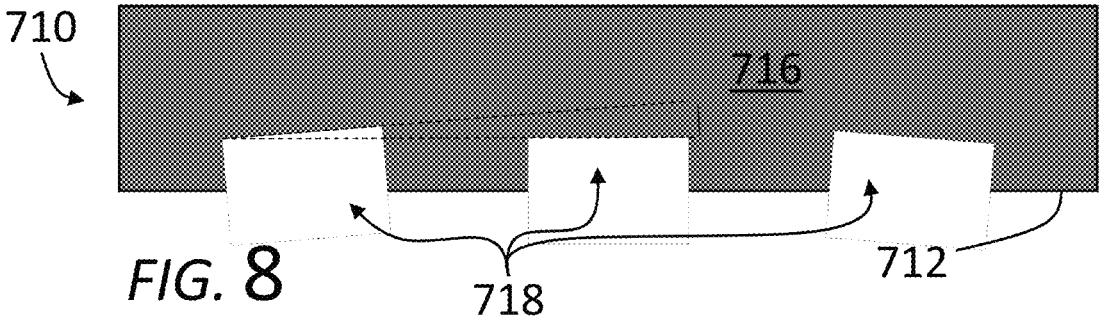

As shown in FIGS. 6-8, for example, the cover 510, 610, 710 may have multiple cavities 518, 618, 718, such as an array of cavities (see also arrays of cavities 312, 314 in FIG. 4). As explained above, according to various embodiments, the cavities 518, 618, 718, extend into bodies 516, 616, 716, of the covers 510, 610, 710 from inside faces 512, 612, 712 of the covers 510, 610, 710, such as to a depth D (see FIG. 6). FIG. 6 shows each of the cavities 518 to be the same depth D and oriented at the same angle relative to one another. FIG. 7 shows the cavities 618 to be to different depths relative to the inside face 612. FIG. 8 shows the cavities 718 to be oriented to different angles relative to one another. In other embodiments, a cover may have cavities that include mixes of same-depth, different depths, same and different angles. Orientation of the cavities and corresponding positioning of antenna patches may facilitate signal reception or transmission, as explained further below.

Referring now to FIGS. 9-12, a waveguide 810 (FIG. 12) may be a component of an antenna, such as to reduce cross-talk between different signals in a multichannel system. According to an exemplary embodiment, the waveguide 810 includes a layer 812 (FIG. 10), such as of polycrystalline ceramic, such as polycrystalline alumina, zirconia, or another inorganic material, or another material combination of such materials, such as having the dielectric constant and other attributes disclosed herein. In other contemplated embodiments, the waveguide 810 may comprise a layer of glass, such as a different glass than that of a corresponding glass cover (see, e.g., FIG. 1). The layer 812 may be thin, such as less than 300 μm, less than 200 μm, less than 100 μm. According to an exemplary embodiment, the waveguide 810 further includes electrically conductors 814, 816 (FIGS. 9 and 11) that overlay at least some of major surfaces of the layer 812, shown in FIG. 12, where the conductors sandwich the layer 812. According to an exemplary embodiment, conductors 814, 816 exhibit conductivity of at least $10^4$ siemens per meter at 20° Celsius (C)), and are of conductive material such as copper, aluminum, gold, silver, translucent conductive oxide (e.g., indium tin oxide, zinc oxide) etc. and may be relatively thin, such as less than 10 microns and/or at least 300 nm thick. In at least some contemplated embodiments, the conductors 814, 816 and/or other conductive structures disclosed herein, may include (e.g., comprise, consist essentially of) carbon nanotubes, which may serve as resonators or otherwise and may be translucent as quantified below.

Figure 9:
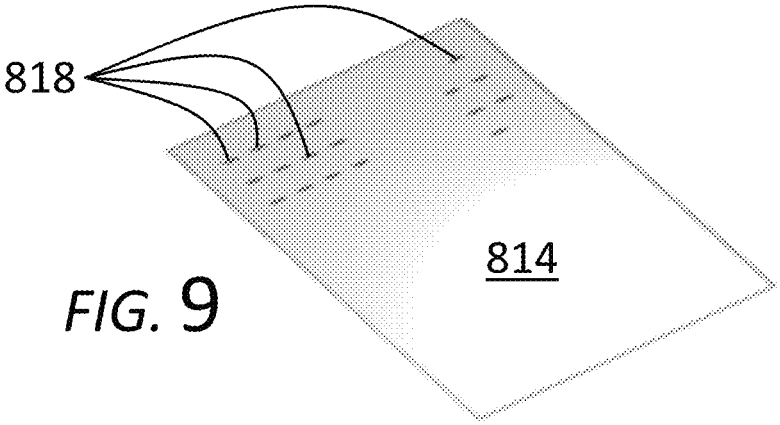
FIGS. 9 and 11 are perspective views of conductors that overlay major surfaces of the waveguide of FIG. 10, with openings that open to the feed channels, according to an exemplary embodiment.
Figure 10:
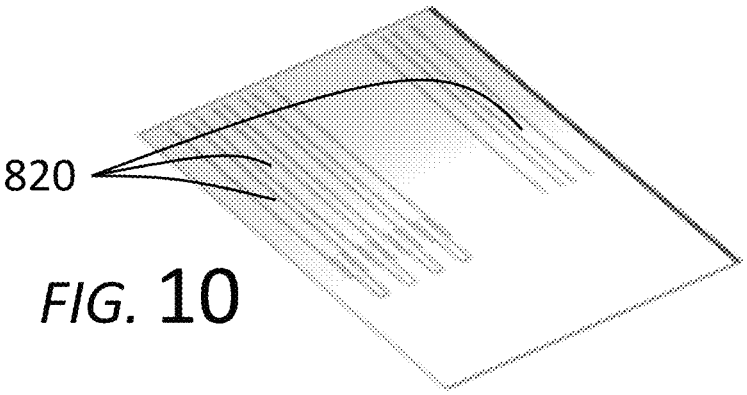
FIG. 10 is a perspective view of a waveguide with feed channels, according to an exemplary embodiment.
Figure 11:
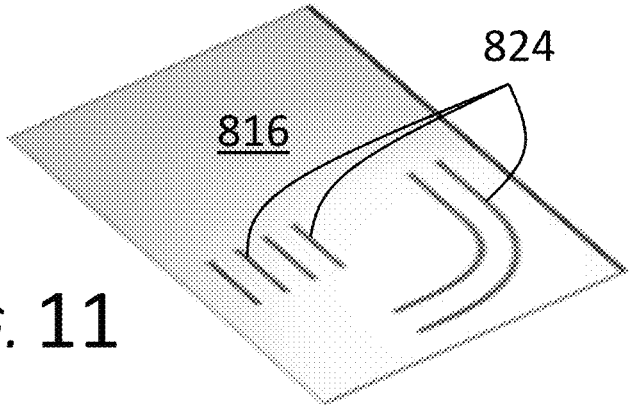

The conductor 814 shown in FIG. 9, may face a cover of an antenna (e.g., cover 310 in FIG. 4) and the conductor 814 includes openings 818 (e.g., slots) that facilitate communication of signals, such as through the openings 818 to and from feed channels 820 formed in the layer 812 of the waveguide 810. The openings may be on the order of tens to hundreds of micrometers, such as a 50×1000 μm rectangular slot. As shown in FIG. 10, the layer 812 includes the feed channels 820, which may be bordered by conductive through-vias 822 located within the layer, partitioning the feed channels 820 from other parts of the layer 812. The conductor 816, shown in FIG. 11, may face a backplate of an antenna (e.g., backplate 410 as shown in FIG. 5) and the conductor 816 also includes openings 824 that open to the feed channels 820.

According to an exemplary embodiment, the conductors 814, 816 on the waveguide layer 812 are visibly translucent (i.e. allow transmittance of light in the visible range). In some such embodiments, the conductors include (e.g., mostly include, are) an oxide, such as indium tin oxide. Further, the waveguide layer (e.g., polycrystalline ceramic) may also be translucent. Such embodiments may provide a relatively transparent antenna (or portion thereof), such as for use with windows or displays. In some embodiments, visible light may pass through at least a portion of the cover and waveguide layer (see, e.g., FIG. 13 and thickness T) such that the combined structure has at least 30% transmittance (e.g., at least 40%, at least 50%) over at least a portion of the visible spectrum, such as at least most of the visible spectrum (380-700 nanometers wavelength). In some embodiments, underlying circuitry may also be mostly translucent and the overall antenna stack (see antenna stack 910) may be visibly translucent as so just described for the portion of the cover and waveguide layer.

According to an exemplary embodiment, electrical properties distinguish material of the layer 812 of the waveguide (e.g., polycrystalline ceramic, comprising or consisting essentially of alumina, comprising zirconia) from that (e.g., glass; alkali-aluminosilicate glass; low thermal expansion glass resistant to thermal shock, as may be induced by water or salt spray on hot/cold days) the body of the cover (e.g., body 216). In some embodiments, the layer 812 has a dielectric constant at least twice that of the body of the cover at 79 GHz at 25° C. In some embodiments, material of the layer 812 of the waveguide has a dielectric constant of at least 7 and/or no more than 8 at 79 GHz at 25° C.

Figure 13:
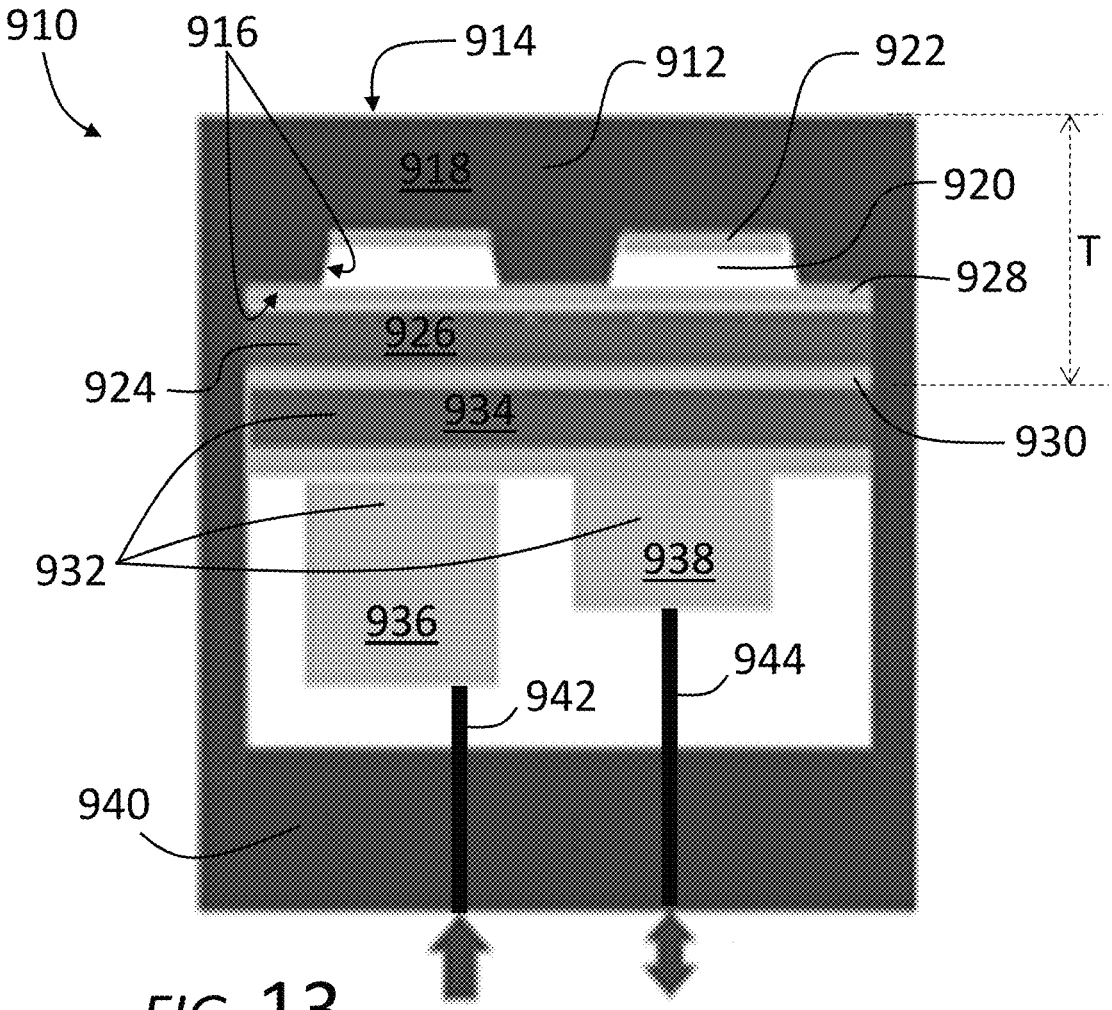
FIG. 13 is a side sectional view of an antenna stack, according to an exemplary embodiment.

According to an exemplary embodiment, the layer 812 of the waveguide and the body of the cover may have similar coefficients of thermal expansion, such as where the coefficient of thermal expansion of glass of the cover is within 20% of that of the polycrystalline ceramic of the waveguide at 25° C. for example. Applicants have found tuning coefficients of thermal expansion mitigates interfacial shear between the cover and waveguide, improving toughness. Furthermore, bonded layers (e.g., laser welded glass/ceramic laminate structure), as disclosed herein (see, e.g., antenna stack 910 as shown in FIG. 13), give each other strength, making the composite structure rigid, thereby providing excellent dimensional stability, such as even to a single digit micrometer over operational conditions. Put another way, the presently disclosed antenna design reduces materials (e.g., protective covers, interlayers, frame, etc.), relative to conventional antennas, while increasing dimensional stability and stiffness, which translates to better beam shape and array accuracy, even in presence of shock, vibration, and temperature change.

Referring now to FIG. 13, an antenna stack 910 may be supported in a housing of an antenna, as shown in FIGS. 1-2, or may be otherwise configured as discussed above. The antenna stack 910 includes a glass cover 912 (see also covers 210, 310 of FIGS. 3-4) having an outer face 914, an inside face 916 opposite the outer face 914, and a body 918 therebetween. The glass cover 912 additionally has a cavity 920 formed therein, extending into the body 918 from the inside face 914.

The antenna stack 910 further includes a waveguide layer 924 (see also waveguide 810 of FIG. 12) including polycrystalline ceramic 926 underlying the glass cover 912. The waveguide layer 924 may be welded (e.g., laser welded) or otherwise bonded directly to the glass cover 912, thereby providing a robust and thin structure. According to an exemplary embodiment, use of a thin cover and thin waveguide allows for a particularly thin, yet robust antenna stack 910. In some embodiments, thickness T of the cover (e.g., glass cover) and waveguide layer together in the antenna stack 910 is less than 2 mm, such as less than 1.4 mm, less than 1 mm, less than 0.6 mm, and/or at least 0.1 mm. Conductive vias (see, e.g., vias 822 of FIG. 12) may extend through the polycrystalline ceramic 926 and partition the waveguide layer 924 to form feed channels (see, e.g., feed channels 820 of FIG. 12) through the polycrystalline ceramic 926 for guidance of signals through the waveguide layer 924. Major surfaces of the polycrystalline ceramic 926 are overlaid with conductors 928, 930 having openings (see, e.g., openings 818, 824 in FIGS. 9 and 11) in the conductors 928, 930 that open to the feed channels extending through the polycrystalline ceramic.

Still referring to FIG. 13, the antenna stack 910 still further includes an antenna patch 922 (e.g., radiative element, center feed patch, metal patch, copper patch) positioned within the cavity 920, such as joined to the cover 912 within the cavity 920 at a location furthest from the inside face 916 of the glass cover 912 (i.e. cavity bottom). Filler (e.g., polymer, resin) may hold the antenna patch 922 in place, filling the cavity 920 and may have properties conducive to signal conveyance. According to an exemplary embodiment, while the waveguide layer 924 may be bonded to the cover 912, the antenna patch 922 is spaced apart from the waveguide layer 924. In some embodiments, the antenna patch 922 is physically spaced apart from the waveguide layer 924 by a distance of at least 10 micrometers and less than 1.4 millimeters, such as due to depth of the cavity 920, such as where none of the antenna patch directly contacts the conductor 928 or is directly connected to the conductor 928 by another conductive element (as defined above). Spacing between the antenna patch 922 and the waveguide layer 924 may facilitate evanescent wave coupling or E-field coupling between the feed channels and the antenna patch 922. In some such embodiments, the antenna patch 922 is not wired (i.e. electrically connected by a conductor) to the waveguide 924, but Applicants believe signals from the waveguide layer 924 induce electron oscillation in the antenna patch 922 through radio-frequency energy coming from the waveguide layer 924, which facilitates radiation in the antenna patch 922.

Referring momentarily to FIGS. 6-8, an array of antenna patches (e.g., antenna patch 922) may be individually positioned in cavities 518, 618, 718 in the cover 510, 610, 710, or may be co-located with groups of antenna patches in one or several larger cavities, such as a group of transmitter antenna patches and a group of receiver antenna patches in two separate larger cavities. As such, due to geometry of the cover 510, 610, 710 and respective cavities 518, 618, 718, depths of antenna patches may vary with respect to one another relative to the inside face 512, 612, 712 of the cover 510, 610, 710, and/or orientation of the antenna patches may vary with respect to one another. Such arrangements may facilitate active antenna arrays with beam shaping. The antenna patches may be relatively thin (e.g., less than ten micrometers thick, at least 300 nm).

Figure 12:
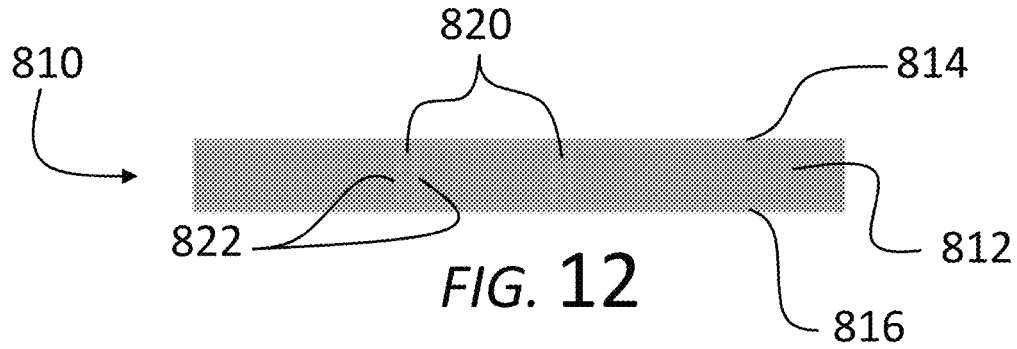
FIG. 12 is a side sectional view of the conductors and waveguide of FIGS. 9-11.

Referring back to FIG. 13, the antenna stack 910 may further include circuitry 932 underlying the waveguide layer 924 and positioned adjacent (e.g., directly adjacent, contacting, under) the major surface of the waveguide layer 924 opposite the glass cover 912, such as where the circuitry 932 may be coupled directly to the feed channels (see feed channels 820, as shown in FIG. 12 for example), further improving signal reliability. The circuitry 932 may include a circuit board 934 (e.g., 120 μm thick glass-reinforced epoxy laminate, such as FR4; radio frequency transceiver and digital signal processor board), such as for routing signals to and from the feed channels, power source/storage 936 (e.g., battery, capacitor), and/or additional circuitry, such as a radar module 938 (e.g., radar chip). In some embodiments, the circuit board 934 may be translucent, as quantifiably defined for the waveguide, to add to translucence of the antenna stack 910, such as where the circuit board 934 may include glass or another translucent material.

In some embodiments, the waveguide layer 926 and circuitry may be hermetically sealed (generally impermeable to air at 25° C. at sea level pressure) between the cover and a backplate, such as a glass backplate 940 (see also backplate 410 as shown in FIG. 3). The cover and backplate may be welded together, such as by laser weld around a perimeter of the antenna stack 910. Conductive through-vias or other wiring 942, 944 may be formed in or otherwise pass through or around the backplate 940, such as to facilitate communication of power or information to the circuitry 932. In other embodiments, the antenna stack 910 may be part of or located within another structure (e.g., portable electronic device) and may not include a backplate, for example. Electronic potting and/or polymer backplates may be used, for example.

According to an exemplary embodiment, dimensions of the antenna stack 920 shown in FIG. 13 are about 20×25 mm and about 3.5 mm thick, such as having a cross-sectional area of less than 1000 $mm^2$ and a thickness of less than 5 mm.

One advantage of the antenna stack described herein may be manufacturability. For example, forming the stack in layers may be on wafers or large-scale sheets with many individual antennas on the same sheet, using manufacturing technology associated with semiconductor and display industries, and then singulating with dicing saws or laser cutting for example. By utilizing evanescent wave coupling between the waveguide feed channels and the antenna patches, manufacturing may not require electrically connecting the antenna patches to the feed channels, thereby simplifying the manufacturing process relative to designs that do require such connections. Further, a lamination-based process, similar to conventional printed circuit board manufacturing techniques, may obviate some or all need for mechanical connectors and/or transitions.

The construction and arrangements of the antenna stack in the various exemplary embodiments, are illustrative only. Although only a few embodiments have been described in detail in this disclosure, many modifications are possible (e.g., variations in sizes, dimensions, structures, shapes, and proportions of the various elements, values of parameters, mounting arrangements, use of materials, colors, orientations) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present inventive technology.

What is claimed is:

1. An antenna stack, comprising, a glass cover having an outer face, an inside face opposite the outer face, and a body therebetween, the glass cover additionally having a cavity formed therein extending into the body from the inside face;

an antenna patch positioned within the cavity; and a waveguide layer welded directly to the glass cover and comprising polycrystalline ceramic, wherein major surfaces of the polycrystalline ceramic are overlaid with an electrical conductor that includes openings in the conductor that open to feed channels extending through the polycrystalline ceramic;

wherein dielectric constant at 79 GHz at 25° C. of the polycrystalline ceramic is at least twice that of glass of the glass cover, and coefficient of thermal expansion of the glass is within 20% of that of the polycrystalline ceramic.

2. The antenna stack of claim 1, wherein combined thickness of the glass cover and waveguide layer is less than 0.6 millimeters.

3. The antenna stack of claim 1, wherein the glass cover is welded to the polycrystalline ceramic of the waveguide layer.

4. The antenna stack of claim 1, further comprising circuitry underlying the waveguide layer and positioned adjacent the major surface of the waveguide layer opposite the glass cover, wherein the circuitry is coupled to the feed channels.

5. The antenna stack of claim 4, further comprising a glass backplate welded directly to the glass cover, wherein the waveguide layer and circuitry are hermetically sealed between the glass cover and the glass backplate.

6. The antenna stack of claim 1, wherein conductive vias extend through the polycrystalline ceramic and partition the waveguide layer to form the feed channels through the polycrystalline ceramic.

7. The antenna stack of claim 6, wherein both the conductive vias and the electrical conductors overlaying the major surfaces of the polycrystalline ceramic comprise copper, aluminum, gold, and/or silver.

8. An antenna stack, comprising, a cover having an outer face, an inside face opposite the outer face, and a body therebetween, the cover additionally having a cavity formed therein extending into the body from the inside face, wherein the body is of a first material, wherein the first material has a dielectric constant at 25° C. at 79 GHz;

an antenna patch positioned within the cavity; and a waveguide layer underlying the cover and bonded thereto, wherein major surfaces of the waveguide layer are overlaid with an electrical conductor that includes openings in the conductor that open to feed channels extending through the waveguide layer, wherein the waveguide layer is of a second material, wherein the second material is inorganic, wherein the second material has a dielectric constant at 79 GHz at 25° C. that is at least twice the dielectric constant of the first material;

wherein the antenna patch is physically spaced apart from the waveguide layer by a distance of at least 10 micrometers and less than 1.4 millimeters.

9. The antenna stack of claim 8, wherein the dielectric constant of the second material is at least 7 at 25° C. and at 79 GHz.

10. The antenna stack of claim 8, wherein the dielectric constant of the second material is no more than 8 at 25° C. and at 79 GHz.

11. The antenna stack of claim 8, wherein depth of the cavity into the body from the inside face is at least 50 micrometers.

12. The antenna stack of claim 8, wherein the electrical conductor comprises copper.

13. The antenna stack of claim 8, further comprising circuitry underlying the waveguide layer and positioned adjacent the major surface of the waveguide layer opposite the cover, wherein the circuitry is coupled to the feed channels.

* * * * *